US007775204B2

(12) United States Patent
Chen

(10) Patent No.: US 7,775,204 B2
(45) Date of Patent: Aug. 17, 2010

(54) WARMING SHOE PAD

(76) Inventor: Long Ho Chen, No. 23, Jiuquan Street, Taipei (TW)

( * ) Notice: Subject to any disclaimer, the term of this patent is extended or adjusted under 35 U.S.C. 154(b) by 762 days.

(21) Appl. No.: 11/649,891

(22) Filed: Jan. 5, 2007

(65) Prior Publication Data

US 2008/0163861 A1 Jul. 10, 2008

(51) Int. Cl.
*A61F 7/08* (2006.01)
*A43B 7/02* (2006.01)
*A43B 7/04* (2006.01)

(52) U.S. Cl. ..... 126/204; 126/205; 126/206; 126/207; 126/208; 126/262; 126/263.01; 431/147; 431/299; 431/319; 431/320; 431/321; 36/26

(58) Field of Classification Search ..... 126/204, 126/205, 206, 207, 208, 262, 263.01–263.09, 126/263.1; 36/2.6; 431/147, 299, 319, 320, 431/321, 323, 326, 328, 329; *A61F 7/06; A43B 7/02, A43B 7/04*

See application file for complete search history.

(56) References Cited

U.S. PATENT DOCUMENTS 51,492 A * 12/1865 Taft ..... 126/208
90,197 A * 5/1869 Rogers ..... 36/2.6
156,117 A * 10/1874 Angresius ..... 36/2.6
382,681 A * 5/1888 Batter ..... 36/2.6
444,395 A * 1/1891 Ellis ..... 126/206
527,598 A * 10/1894 Ellis ..... 126/206
566,662 A * 8/1896 Cochrane ..... 126/206
660,957 A * 10/1900 Hermans ..... 126/207
728,703 A * 5/1903 Gerard ..... 36/2.6
1,015,661 A * 1/1912 Akahori et al ..... 126/206
1,272,931 A * 7/1918 Etheridge ..... 36/2.6
1,290,882 A * 1/1919 Benn ..... 126/204
1,502,251 A * 7/1924 Kanazawa ..... 126/208
1,609,958 A * 12/1926 Perrault ..... 126/263.02
1,702,583 A * 2/1929 Williams ..... 219/211
2,579,620 A * 12/1951 Smith ..... 126/208
2,670,728 A * 3/1954 Smith ..... 126/208
2,680,918 A * 6/1954 Behner ..... 36/2.6
3,046,975 A * 7/1962 Gottwald ..... 126/208
3,049,117 A * 8/1962 Matoba ..... 126/208
3,295,510 A * 1/1967 Matoba ..... 126/208
3,563,226 A * 2/1971 Rockenfeller et al. ..... 126/204
3,585,736 A * 6/1971 Polichena ..... 36/2.6
3,738,350 A * 6/1973 Stiles ..... 126/19 R (Continued)

FOREIGN PATENT DOCUMENTS

EP 244880 A1 * 11/1987

(Continued)

*Primary Examiner*—Steven B McAllister
*Assistant Examiner*—Daniel E Namay

(57) ABSTRACT

A device for warming a shoe is disclosed. An insole has a top cavity. A releasable shoe pad includes a top padding member and a recess between forward and rearward bottom portions. The device includes a thin metal member formed on the pad and including an intermediate conductive member, a forward conductive section extended from the conductive member, and a rearward conductive section extended from the conductive member, and a heater unit fastened in a space defined by the recess. The heater unit includes a fuel chamber, a combustion chamber filled with zirconia fibers, and a channel interconnected the fuel and the combustion chambers, the channel including fibers and a wick having one end immersed in the fuel chamber and the other end connected to the fibers.

3 Claims, 7 Drawing Sheets

U.S. PATENT DOCUMENTS

| | | | | | |
|---|---|---|---|---|---|
| 3,785,362 | A * | 1/1974 | Okui | 126/208 |
| 3,935,856 | A * | 2/1976 | Loftin | 126/208 |
| 4,061,128 | A * | 12/1977 | Storey | 126/210 |
| 4,068,651 | A * | 1/1978 | Rappaport | 126/208 |
| 4,094,080 | A * | 6/1978 | Sanders | 36/2.6 |
| 4,180,922 | A * | 1/1980 | Cieslak et al. | 36/2.6 |
| 4,255,285 | A * | 3/1981 | Engelbach et al. | 502/80 |
| 4,281,418 | A * | 8/1981 | Cieslak et al. | 2/160 |
| 4,373,274 | A * | 2/1983 | Michalski | 36/2.6 |
| 4,441,483 | A * | 4/1984 | Cieslak et al. | 126/206 |
| 4,800,867 | A * | 1/1989 | Owens | 126/204 |
| 4,841,646 | A * | 6/1989 | Maurer, Jr. | 36/2.6 |
| 4,894,931 | A * | 1/1990 | Senee et al. | 36/2.6 |
| 4,910,881 | A * | 3/1990 | Baggio et al. | 36/2.6 |
| 4,927,622 | A * | 5/1990 | Jade | 423/608 |
| 5,230,170 | A * | 7/1993 | Dahle | 36/2.6 |
| 5,495,682 | A * | 3/1996 | Chen | 36/2.6 |
| 6,239,501 | B1 * | 5/2001 | Komarechka | 290/1 R |
| 6,255,799 | B1 * | 7/2001 | Le et al. | 320/107 |
| 6,418,643 | B1 * | 7/2002 | Yang | 36/101 |
| 7,347,831 | B2 * | 3/2008 | Chiu | 601/15 |
| 7,611,767 | B2 * | 11/2009 | Usui et al. | 428/208 |
| 2007/0278201 | A1 * | 12/2007 | Jones et al. | 219/211 |

FOREIGN PATENT DOCUMENTS

| | | | |
|---|---|---|---|
| EP | 315004 | A2 * | 5/1989 |
| EP | 368705 | A1 * | 5/1990 |
| EP | 368706 | A1 * | 5/1990 |
| EP | 373009 | A1 * | 6/1990 |
| GB | 2234665 | A * | 2/1991 |
| JP | 56059158 | A * | 5/1981 |
| JP | 61037201 | A * | 2/1986 |
| JP | 01164366 | A * | 6/1989 |
| JP | 01292781 | A * | 11/1989 |
| JP | 01320071 | A * | 12/1989 |
| JP | 02131760 | A * | 5/1990 |
| JP | 05023201 | A * | 2/1993 |
| JP | 05176951 | A * | 7/1993 |
| JP | 06304004 | A * | 11/1994 |
| JP | 2002-61003 | A * | 2/2002 |
| WO | WO 8605663 | A1 * | 10/1986 |
| WO | WO 9012516 | A1 * | 11/1990 |
| WO | WO 9208381 | A1 * | 5/1992 |

* cited by examiner

WARMING SHOE PAD

BACKGROUND OF THE INVENTION

1. Field of Invention

The invention relates to warming shoe pad and more particularly to a shoe having a heater unit mounted in the shoe pad for warming the foot wearing the shoe.

2. Description of Related Art

There have been numerous suggestions in prior patents for warming the foot wearing a shoe. For example, U.S. Pat. No. 3,935,856 (hereinafter "the '856 patent") describes a shoe and foot warmer. The '856 patent discloses a metal base unit 20 and a metal external cap 13 hingedly connected to a forward hinge 14 on the base unit 20. Thus, the cap 13 is adapted to externally mount on a shoe 30 with a lower concave recess 33 fitted about a toe cap 31 of the shoe 30. A heater unit 10 fastens over the toe cap 31 by means of attached straps 11 and buckles 12. The base unit 20 is filled with cotton which holds the liquid fuel. A rotary damper valve 38 fits between wick (i.e., heating element) 16 and the base unit 20 for regulating the amount of fuel vapors reaching the wick 16 since the wick 16 is not in direct contact with the liquid fuel in the base unit 20. In operation, the hinged cap 13 is opened and the wick 16 is ignited to emit a steady glow. Then the cap 13 is closed to warm the attached toe cap 31 of the shoe 30 by heating the heater unit 10.

However, the '856 patent suffered from several disadvantages. For example, the externally mounted heater unit 10 is not visually aesthetic. Also, it may hinder walking while wearing the shoe. Further, the heater unit 10 may disengage with the shoe 30 if one or more fastening portions of the straps 11 and the buckles 12 loosen. Furthermore, heat transfer efficiency is low since the heater unit 10 is mounted externally on the shoe 30, i.e., the feet may still feel cold when wearing the shoes 30 mounted with the heater units 10. Thus, the need for improvement still exists.

SUMMARY OF THE INVENTION

It is therefore one object of the invention to provide a warming shoe pad having advantages of not hindering walking while wearing shoes incorporating the warming shoe pad, and high heat transfer efficiency so as to supply sufficient heat to the foot.

In one aspect of the invention there is provided a device for warming a shoe including an insole having a top cavity, and a releasable shoe pad including a top padding member, a forward bottom portion, a rearward bottom portion, and a recess between the forward and the rearward bottom portions, comprising a thin metal member formed on the pad; and a heater unit fastened in a space defined by the recess and the cavity, the heater unit including a fuel chamber, a combustion chamber, and a channel interconnected the fuel chamber and the combustion chamber, the channel including fibers filled therein and an extending wick having one end immersed in the fuel chamber and the other end connected to the fibers, wherein fuel in the fuel chamber is adapted to reach the combustion chamber through the wick and the fibers in a form of vapor for ignition.

In another aspect of the invention there is provided a device for warming a shoe including an insole having a smooth top surface, and a releasable shoe pad including a top padding member, a forward bottom portion, a rearward bottom portion, and a recess between the forward and the rearward bottom portions, comprising a thin metal member formed on the pad; and a heater unit fastened in the recess, the heater unit including a fuel chamber, a combustion chamber, and a channel interconnected the fuel chamber and the combustion chamber, the channel including fibers filled therein and an extending wick having one end immersed in the fuel chamber and the other end connected to the fibers, and wherein fuel in the fuel chamber is adapted to reach the combustion chamber through the wick and the fibers in a form of vapor for ignition.

In a further aspect of the invention there is provided a device for warming a shoe including an insole having a smooth top surface, and a releasable shoe pad including a top padding member, a forward bottom portion, a rearward bottom portion, and a recess between the forward and the rearward bottom portions, comprising a thin metal member formed on the pad; and a heater unit fastened in the recess, the heater unit including a fuel chamber, a combustion chamber, and a channel interconnected the fuel chamber and the combustion chamber, the channel including fibers filled therein and an extending wick having one end immersed in the fuel chamber and the other end connected to the fibers, wherein bottoms of the forward and the rearward bottom portions are formed with hooks and the top surface of the insole is formed with an adhesive pile so as to form a Velcro type fastener; and wherein fuel in the fuel chamber is adapted to reach the combustion chamber through the wick and the fibers in a form of vapor for ignition.

Preferably, the metal member comprises an intermediate conductive member, a forward conductive section extended from the conductive member and forming a plurality of first closed loops, and a rearward conductive section extended from the conductive member forming a plurality of second closed loops.

Preferably, the combustion chamber comprises zirconia ($ZrO_2$) fibers filled therein.

Preferably, a sliding cover is mounted along two side potions of the combustion chamber by way of two opposite pair guiding groove rails, the cover including a plurality of apertures for vapor communication.

Preferably, a forward bottom portion has a plurality of parallel first teeth having a slope in a forward direction, and a rearward bottom portion has a plurality of parallel second teeth having a slope in a forward direction wherein the first and the second teeth are adapted to securely engage with the top surface of the insole.

The above and other objects, features and advantages of the invention will become apparent from the following detailed description taken with the accompanying drawings.

DETAILED DESCRIPTION OF THE INVENTION

Figure 1:
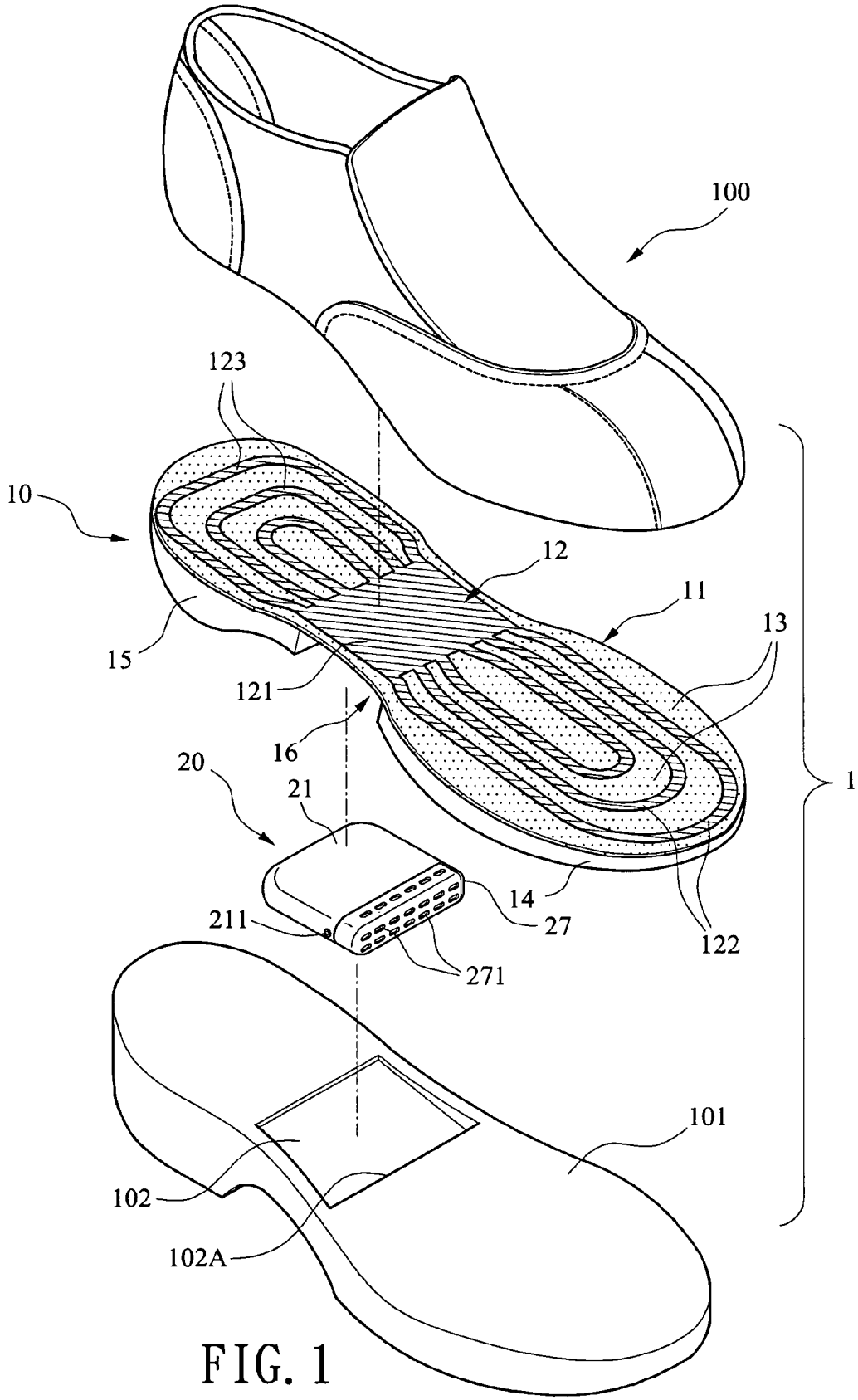
FIG. 1 is an exploded view of a shoe incorporating a first preferred embodiment of warming shoe pad according to the invention.
Figure 2:
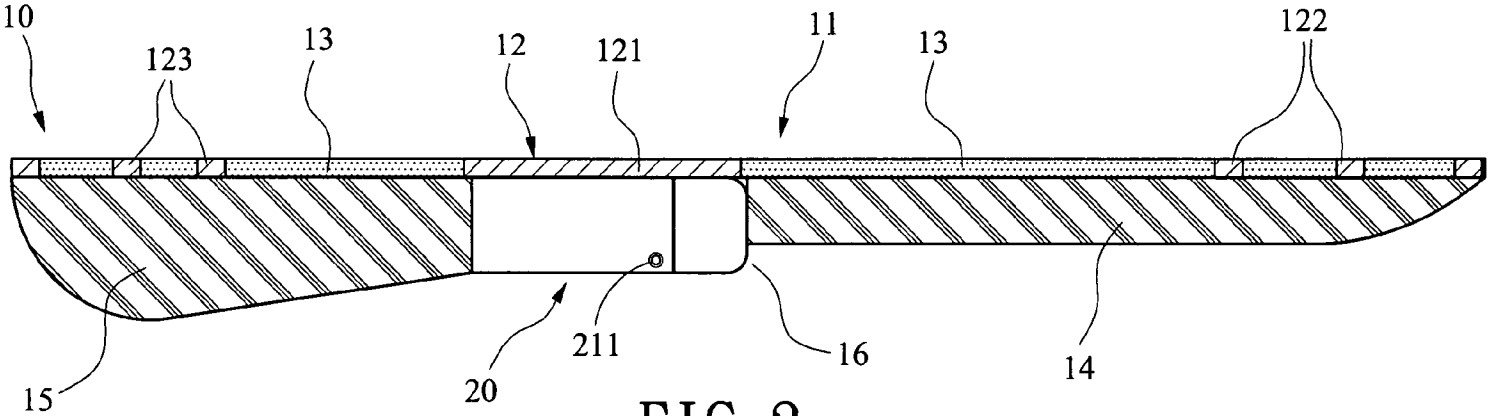
FIG. 2 is a sectional view of the assembled shoe pad and heater unit.
Figure 3:
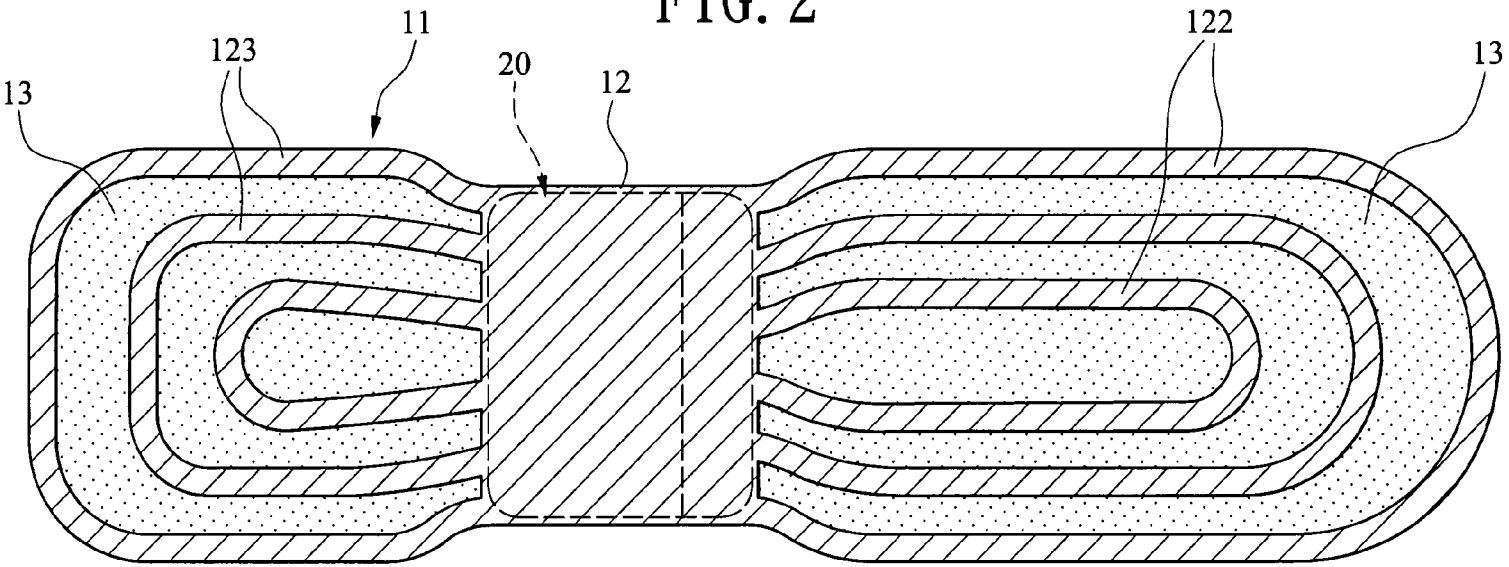
FIG. 3 is a top plan view of FIG. 2.
Figure 4:
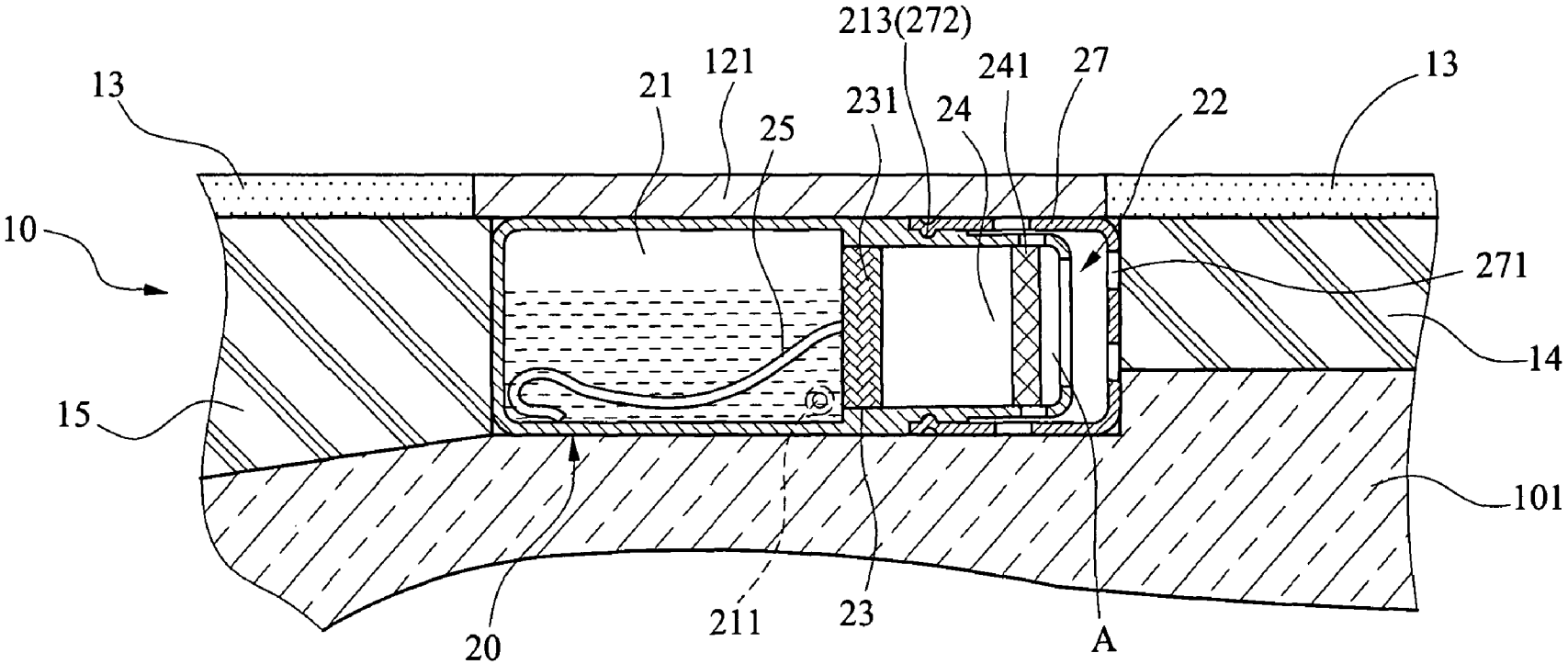
FIG. 4 is a sectional, enlarged view of the heater unit mounted in the shoe pad.

Referring to FIGS. 1 to 6, a first preferred embodiment 1 of a warming shoe pad according to the invention is shown. The first embodiment comprises a releasable shoe pad 10 which is available to be released from the shoe to fuel, to ignite, or to clean, and comprises a padding member 11 formed thereon; a thin metal member 12 formed on the padding member 11 and including a conductive member 121 on a middle portion of the padding member 11, a forward conductive section 122 extended from the conductive member 121 and forming a plurality of closed loops on a front portion of the padding member 11, and a rearward conductive section 123 extended from the conductive member 121 and forming a plurality of closed loops on a rear portion of the padding member 11; and a connection web 13 formed of plastics or rubber for forming on the top of the padding member 11 and also filling areas on the padding member 11 not occupied by the metal member 12. The connection web 13 has a smooth surface for providing a degree of flexible and comfortable for the sole while wearing a shoe in walking, running or doing exercise incorporating the invention.

The shoe pad 10 further comprises a forward bottom portion 14 and a rearward bottom portion 15. Each of the forward and rearward bottom portions 14 and 15 is formed of sponge, EVA (ethylene vinyl acetate), foam, or rubber. A recess 16 is formed between the portions 14 and 15 below the conductive member 121.

The heater unit 20 is a substantially rectangular casing and is adapted to have its major portion fitted in the recess 16. The heater unit 20 is secured under the conductive member 121 by spot welding. The heater unit 20 comprises a rectangular fuel chamber 21 filled with volatile liquid fuel (e.g., pentane) and including a side filling hole 211; and a forward heating element 22 including a combustion chamber 24 and a channel 23 interconnected the fuel chamber 21 and the combustion chamber 24. A cotton wick 25 is disposed in the fuel chamber 21 and has one end immersed in the fuel of the fuel chamber 21 and the other end connected to cotton fibers 231 in the channel 23. Thus, fuel in the fuel chamber 21 is adapted to reach the combustion chamber 24 through the wick 25 and the fibers 231. Fuel then vapors in the combustion chamber 24 to ignite. Preferably, the combustion chamber 24 is filled with zirconia ($ZrO_2$) fibers. A platinum film is formed around each zirconia fiber so as to effect a flameless burning in the combustion chamber 24. Heat generated by the zirconia fibers is about 10 to 50 times higher than that of a battery or about three to five times higher than that of gas (on same volume base). Thus, it is a safe and high heating value fuel.

Figure 6:
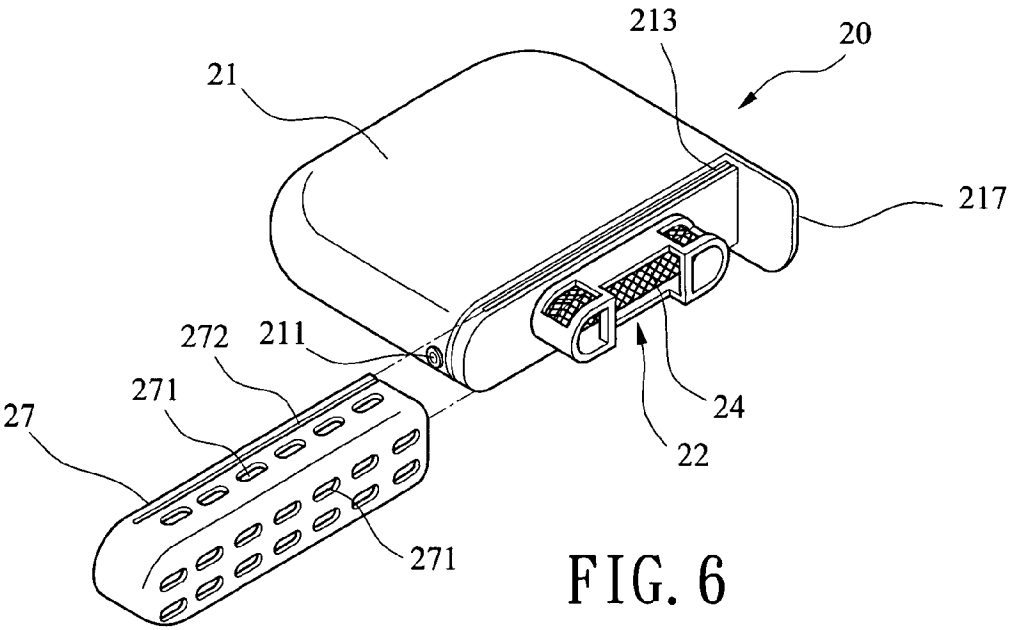
FIG. 6 is an exploded perspective view of the heater unit.

Referring to FIG. 6 specifically, an elongated, rectangular cover 27 has a pair of guiding rails 272 along top and bottom edges of a rear end. The rails are adapted to slide along top and bottom grooves 213 on top and bottom edges of a front face of the combustion chamber 24 so as to conceal or expose the heating element 22. One end of the cover 27 is cut out and opened. The cut end of the cover 27 is adapted to matingly engage with a rectangular end plate 217 extended from one side of the front face of the combustion chamber 24 to form a closed cover when the cover 27 slides along the top and bottom grooves 213 from the other end of the front face of the combustion chamber 24 to one end thereof. The cover 27 comprises a plurality of apertures 271 for vapor communication.

Figure 5:
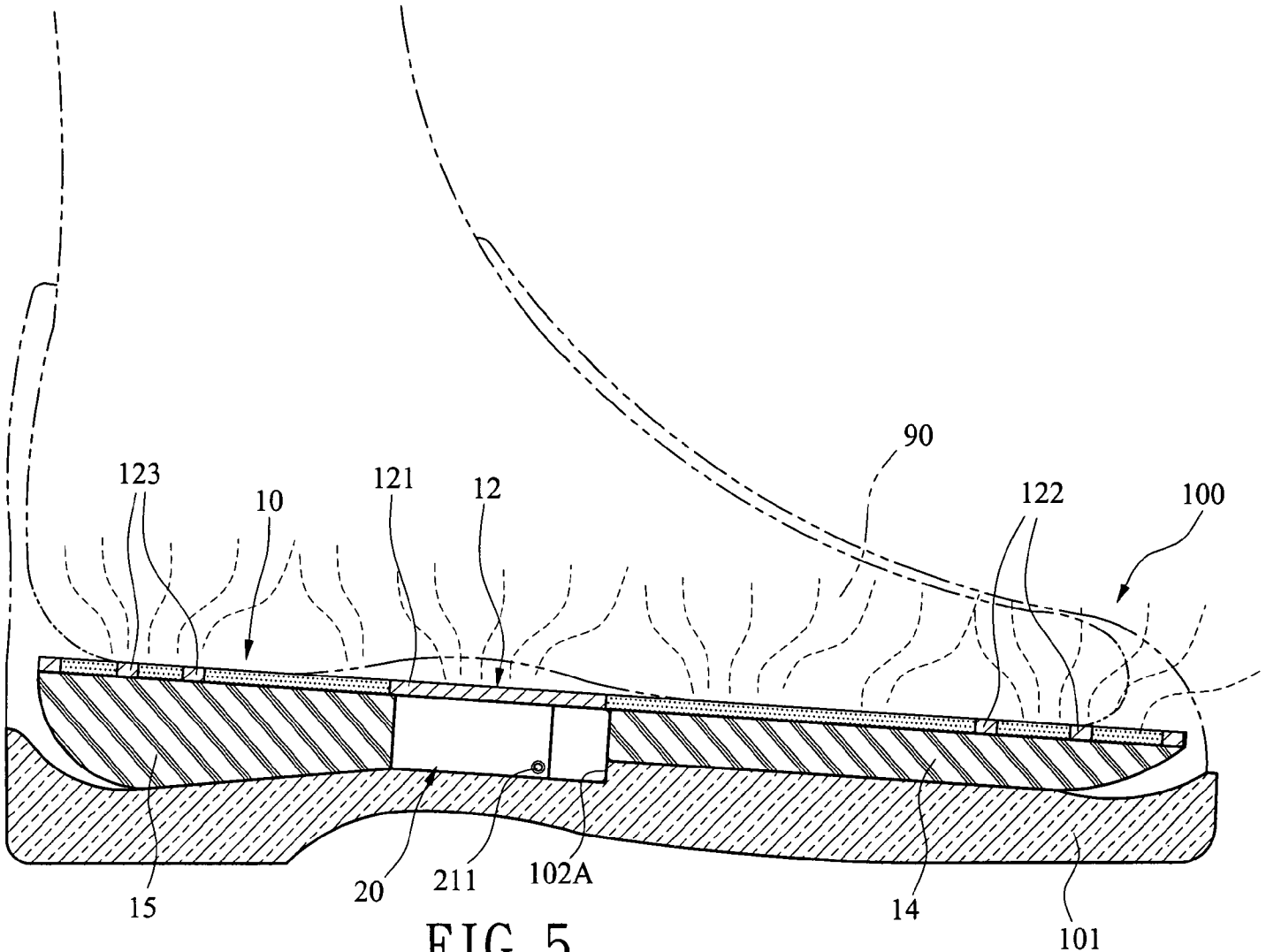
FIG. 5 is a schematic side view in part section of the foot wearing the shoe incorporating the first preferred embodiment of shoe pad warmer.

As shown in FIG. 1, the shoe 100 comprises an insole 101 having a top cavity 102 with a small portion of the heater unit 20 fitted in the cavity 102. A shoulder 102A is formed on a front end of the cavity 102. The shoulder 102A is adapted to fasten and latch the heater unit 20 therein, as shown in FIG. 5. Width of the metal member 12 is slightly less than that of the middle portion of the shoe 100 for facilitating ventilation and burning of the heater unit 20.

A user may ignite the heater unit 20 by means of a lighter or the like after having released the shoe pad from the shoe. As shown in FIG. 5, heat generated by the heater unit 20 then transfers to the metal member 12 including the conductive member 121, the forward conductive section 122, and the rearward conductive section 123, i.e., all over the padding member 11. As a result, the foot 90 wearing the shoe 100 will keep warm and the user will feel a degree of comfort on the foot 90, especially in winter.

Figure 7:
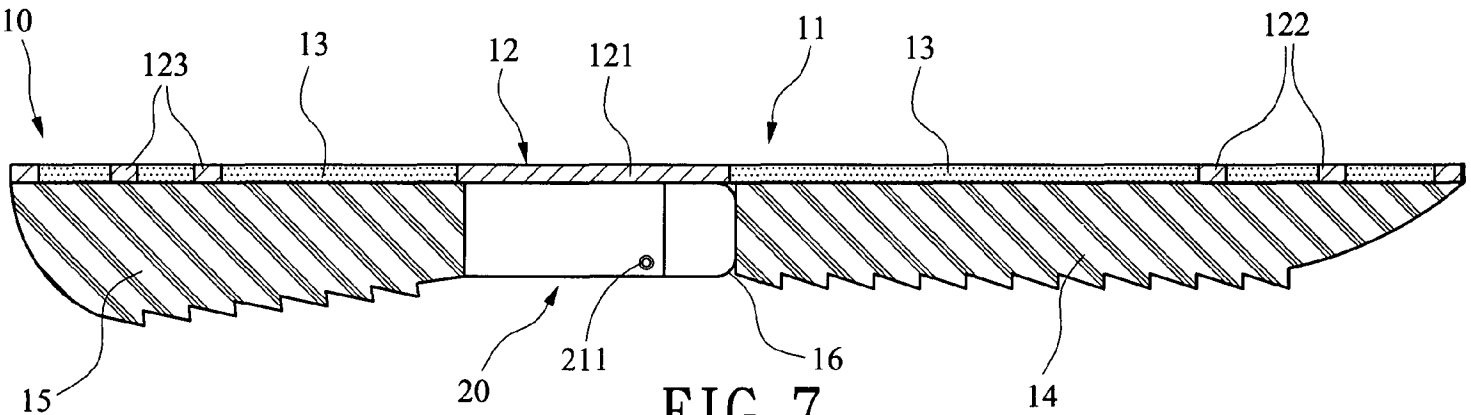
FIG. 7 is a sectional view of a heater unit assembled with a shoe pad to form a second preferred embodiment of warming shoe pad according to the invention.
Figure 8:
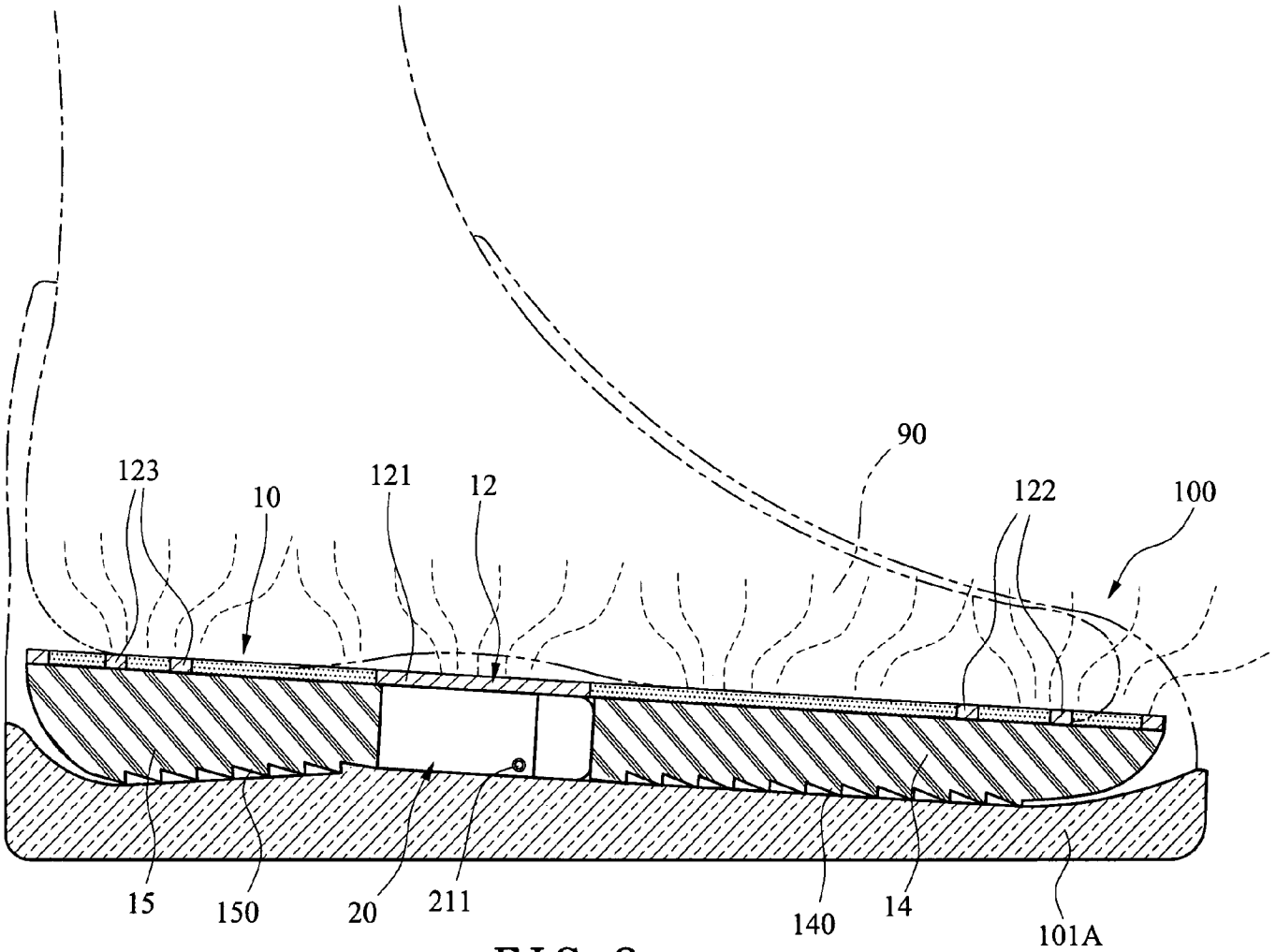
FIG. 8 is a schematic side view in part section of the foot wearing the shoe incorporating the second preferred embodiment of shoe pad warmer.

Referring to FIGS. 7 and 8, a second preferred embodiment of warming shoe pad according to the invention is shown. The second embodiment is identical to the first embodiment, except that an insole 101A has a smooth top surface (i.e., elimination of the top cavity) and the thickness of the forward and rearward bottom portions 14 and 15 are the same in order to put the warming shoe pad of this embodiment on the smooth top surface of the insole to enable the user to use it to the conventional shoe having a regular top surface of insole. Preferably, a bottom surface of each of the forward and rearward bottom portions 14 and 15 may further provide parallel teeth 140 or 150 having a slope in a forward direction. The heater unit 20 is completely fitted in the recess 16. The engagement of the teeth 140 and 150 with the top surface of the insole 101A is positively secured.

Figure 9:
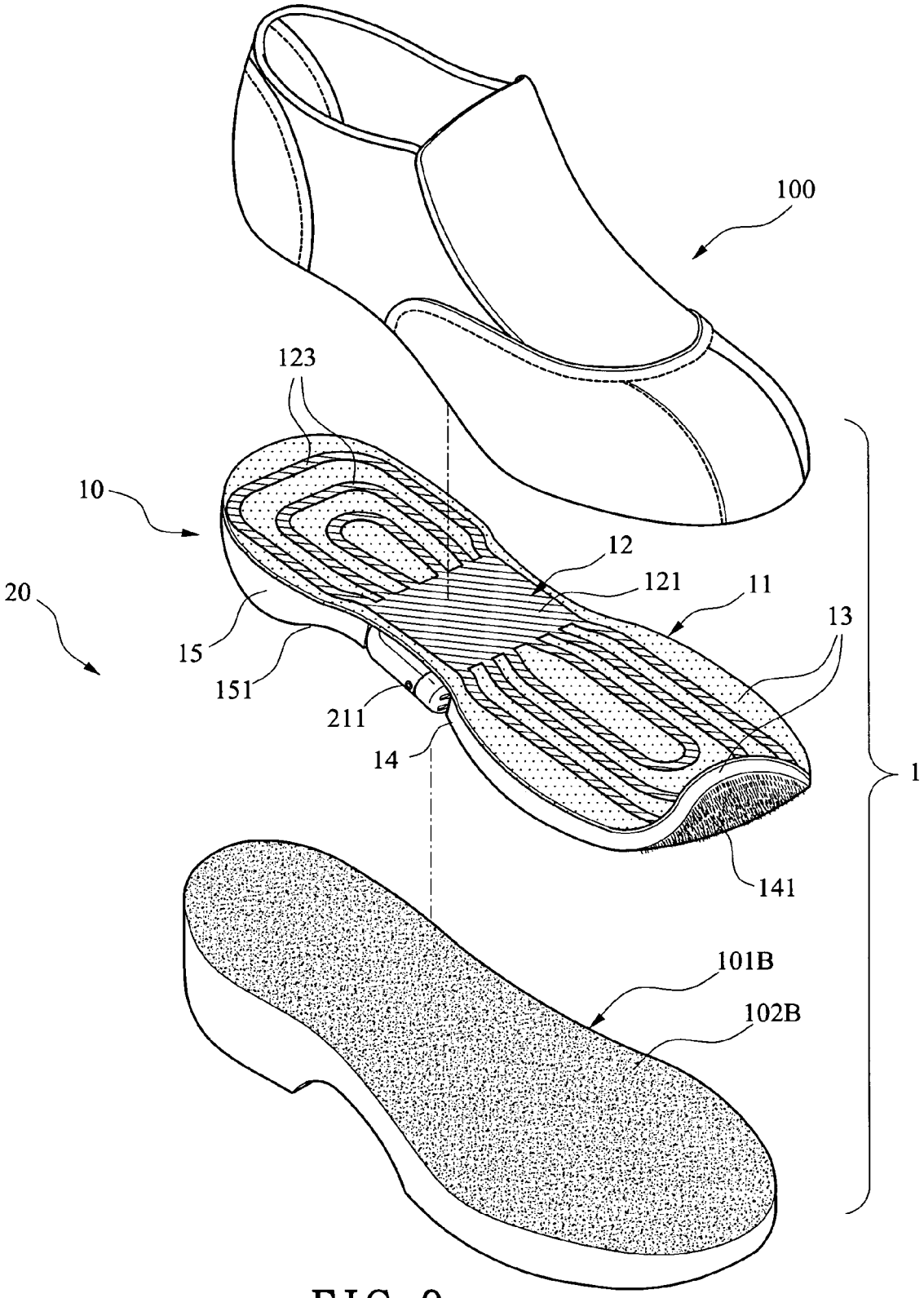
FIG. 9 is an exploded view of a shoe incorporating a third preferred embodiment of warming shoe pad according to the invention.

Referring to FIG. 9, a third preferred embodiment of warming shoe pad according to the invention is shown. The third embodiment is identical to the second embodiment, except that a bottom surface of each of the forward and rearward bottom portions 14 and 15 is formed with tiny hooks 141 and 151. An adhesive pile 102 B is formed on a top surface of an insole 101B. The tiny hooks 141, 151 and the adhesive pile 102B may form a Velcro type fastener and adapt to releasably secure to the hooks. This has the advantage of easy fastening or unfastening of the shoe pad 10 and the insole 101B.

While the invention herein disclosed has been described by means of specific embodiments, numerous modifications and variations could be made thereto by those skilled in the art without departing from the scope and spirit of the invention set forth in the claims.

What is claimed is:

1. A device for warming a shoe including an insole having a top cavity, and a releasable shoe pad comprising:

a thin metal member formed on the shoe pad, the metal member comprising an intermediate conductive member, a forward conductive section extended from the conductive member and forming a plurality of first closed loops, and a rearward conductive section extended from the conductive member forming a plurality of second closed loops; and a heater unit disposed under the shoe pad, the heater unit comprising a fuel chamber, a combustion chamber, and a channel interconnected between the fuel chamber and the combustion chamber, the channel including fibers filled therein and an extending wick having one end immersed in the fuel chamber and the other end connected to the fibers, wherein the combustion chamber comprises zirconia ($ZrO_2$) fibers filled therein;

wherein fuel in the fuel chamber is adapted to reach the combustion chamber through the wick and the fibers in a form of vapor for ignition.

2. A device for warming a shoe comprising a shoe pad including a top padding member, a forward bottom portion, a rearward bottom portion, and a recess between the forward and the rearward bottom portions, comprising:

a thin metal member formed on the pad, the metal member comprising an intermediate conductive member, a forward conductive section extended from the conductive member and forming a plurality of first closed loops, and a rearward conductive section extended from the conductive member forming a plurality of second closed loops; and a heater unit fastened in the recess, the heater unit including a fuel chamber, a combustion chamber, and a channel interconnected between the fuel chamber and the combustion chamber, the channel including fibers filled therein and an extending wick having one end immersed in the fuel chamber and the other end connected to the fibers, wherein the bottoms of the forward bottom portion and the rearward bottom portion are adapted to engage with a top surface of an insole; and wherein fuel in the fuel chamber is adapted to reach the combustion chamber through the wick and the fibers in a form of vapor for ignition.

3. A device for warming a shoe comprising an insole having a top surface, and a releasable shoe pad including a top padding member, a forward bottom portion, a rearward bottom portion, and a recess between the forward and the rearward bottom portions, comprising:

a thin metal member formed on the pad, the metal member comprising an intermediate conductive member, a forward conductive section extended from the conductive member and forming a plurality of first closed loops, and a rearward conductive section extended from the conductive member forming a plurality of second closed loops; and a heater unit fastened in the recess, the heater unit including a fuel chamber, a combustion chamber, and a channel interconnected between the fuel chamber and the combustion chamber, the channel including fibers filled therein and an extending wick having one end immersed in the fuel chamber and the other end connected to the fibers, wherein bottoms of the forward and the rearward bottom portions are formed with hooks and the top surface of the insole is formed with an adhesive pile so as to adapt to releasably secure to the hooks; and wherein fuel in the fuel chamber is adapted to reach the combustion chamber through the wick and the fibers in a form of vapor for ignition.

* * * * *